United States Patent [19]

Huber

[11] 4,140,326

[45] Feb. 20, 1979

[54] SKATEBOARD AND ACCESSORY

[76] Inventor: Paul A. Huber, 2543 Harriett La., Anaheim, Calif. 92804

[21] Appl. No.: 780,261

[22] Filed: Mar. 23, 1977

[51] Int. Cl.[2] ..... A63C 17/04

[52] U.S. Cl. ..... 280/87.04 A; 280/11.2

[58] Field of Search ..... 280/11.2, 87.04 K, 609, 280/18, 82.04 A; 188/5; D34/15 AJ, 14 R, 14 C; 9/310 G, 310 A, 310 AA, 310 B

[56] References Cited

U.S. PATENT DOCUMENTS

| | | | |
|---|---|---|---|
| 2,308,251 | 1/1943 | Terzi | 280/11.2 |
| 2,315,342 | 3/1943 | Lieberman | 280/11.2 |
| 2,450,285 | 9/1948 | Lidberg | 280/18 |
| 3,565,454 | 2/1971 | Stevenson | 280/87.04 A |
| 3,990,713 | 11/1976 | Hokanson | 280/11.2 X |
| 4,031,988 | 6/1977 | Hill | 280/11.2 X |

FOREIGN PATENT DOCUMENTS

| | | | |
|---|---|---|---|
| 1029590 | 5/1966 | United Kingdom | 280/87.04 A |

*Primary Examiner*—Joseph F. Peters, Jr.
*Assistant Examiner*—Milton L. Smith
*Attorney, Agent, or Firm*—Fulwider, Patton, Rieber, Lee & Utecht

[57] ABSTRACT

An accessory for a skateboard which comprises a plastic wedge with through apertures for receiving fasteners to secure the wedge to selected portions of a skateboard. The wedge has dimensions of a width approximating the width of the skateboard and a length permitting it to be mounted behind the rear truck on the undersurface of a skateboard with its thick, trailing edge adjacent the rear edge of the skateboard, whereby the wedge can serve as a skid or pivot plate. The wedge also has appropriate dimensions and an occluded angle permitting it to be mounted on the upper surface of a skateboard at the fore and aft ends to convert a skateboard having a flat deck to a single or double kicktail board.

10 Claims, 4 Drawing Figures

SKATEBOARD AND ACCESSORY

BACKGROUND OF THE INVENTION

1. Field of the Invention

This invention relates to an accessory for a skateboard and, in particular, to the combination of a skateboard having one or more of the accessories.

2. Brief Description of the Prior Art

There are presently a number of designs of skateboards on the market such as the kicktail and double kicktail which have the aft or aft and fore ends of the skateboard deck inclined upwardly at an angle of about 15°, thereby permitting the rider to perform pivotal movements such as wheelies and the like without scraping the end of the skateboard on the pavement. Other skateboard decks are flat relatively rigid members commonly formed of laminated hardwoods and flexible decks formed of metal or fiber-reinforced plastics.

Complex maneuvers performed by riders frequently cause the aft end of the skateboard to contact the pavement, resulting in abnormal wear on the board and often causing spills because of the frictional drag of the board on the pavement. Metal skid plates have been employed to prevent or reduce the wear on the skateboard, however, these plates mark the pavement surface and are particularly objectionable when the skateboards are used on easily marred pavements such as swimming pools and the like.

It is also desirable to have the capability of converting a skateboard from a flat platform style to a kicktail or double kicktail.

BRIEF STATEMENT OF THE INVENTION

This invention comprises an accessory for skateboards and the combination of a skateboard modified with the accessory.

The accessory of the invention comprises a plastic wedge having attachment means permitting its attachment to any of several selected locations on a skateboard. The preferred attachment means comprises a plurality of through apertures to receive fasteners, screws and the like whereby the accessory can be removably attached to a skateboard surface. The wedge has a width approximately the width of a skateboard and a length which permits it to be mounted behind the rear truck on the undersurface of a skateboard with its sharp leading edge adjacent the rear edge of the aft truck and its thick, trailing edge adjacent the rear edge of the skateboard. The wedge has an occluded angle of from 5 to about 20, preferably from 7 to about 15, degrees, thereby permitting the wedge to be mounted on the upper surface of a flat decked skateboard whereby such skateboard can be modified to a kicktail or double kicktail board.

The wedge is formed of a suitable wear resistant plastic, preferably a plastic having a very low coefficient of friction such as Celcon, Teflon, Nylon and the like.

BRIEF DESCRIPTION OF THE DRAWINGS

The invention will be described with reference to the figures of which.

DESCRIPTION OF THE PREFERRED EMBODIMENTS

Figure 1:
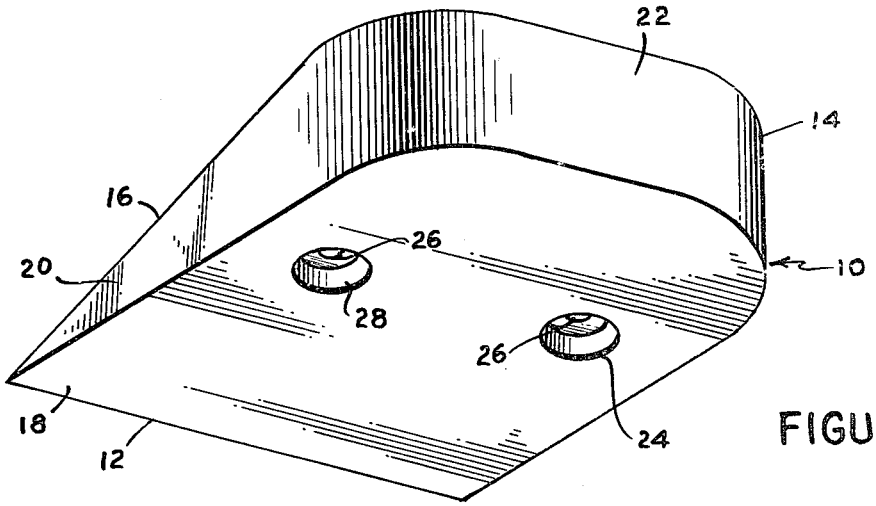
FIG. 1 is a perspective view of the accessory wedge of the invention.

Referring now to FIG. 1, the accessory wedge of the invention is shown as a wedge member 10 having a sharp leading edge 12 and a thick trailing edge 14. The wedge is defined by opposite, planar faces 16 and 18 with upright or generally perpendicular sidewalls, such as 20, and rear wall 22. The wedge has an occluded angle from 5 to about 20, preferably 7 to about 15, and most preferably 10 to 15, degrees. The wedge is provided with attachment means 24 in the form of a plurality of through apertures 26 to receive fastening means such as screws, bolts and the like. The apertures 26 are counterbored at 28 with a larger diameter bore to provide a recessed cavity for recessed reception of the heads of the fastening means.

Figure 2:
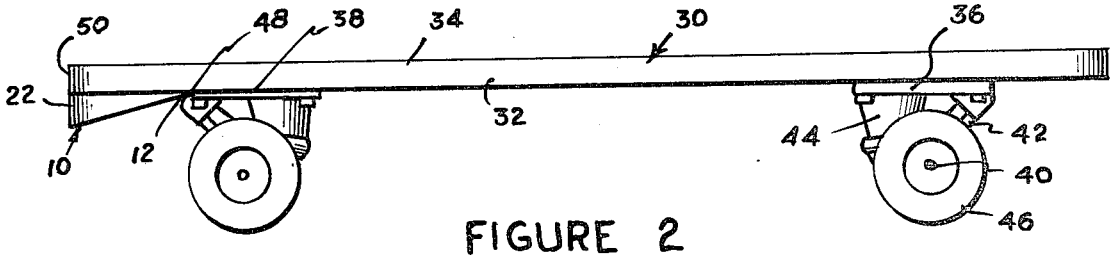
FIG. 2 illustrates a skateboard having a flat deck modified with the accessory.

Referring now to FIG. 2, there is illustrated a skateboard 30 having a platform 32 with a substantially flat or planar deck 34. The skateboard is provided with conventional fore and aft trucks 36 and 38 which carry an axle 40 rotatably mounted therein in suitable bearings. The axles are supported by the trucks with provision for tilting movement of the axle about a mounting axis 42. To this end, the mounting axis 42 is engaged in a shock cushioning member 44 formed of a resilient plastic such as polyurethane and the like. The skateboard wheels 46 are carried on the distal portions of the truck axles 40.

The accessory wedge 10 of the invention is employed as a frictional resistant skid member by mounting the wedge 10 with its sharp leading edge 12 adjacent the rear edge 48 of the aft truck 38 and with its thick trailing edge 22 adjacent the rear edge 50 of the skateboard platform 32. The wedge 10 has a width approximating the width of the platform 32 whereby it extends across substantially the entire width of the trailing edge 50 of platform 32. In this position, the accessory wedge serves as a low frictional member to provide a frictional resistant contact with pavement and the like during maneuvering actions such as wheelies and the like and prevents wear of the rear edge of the skateboard platform 32 and avoids any marking or defacing of pavement.

Figure 3:
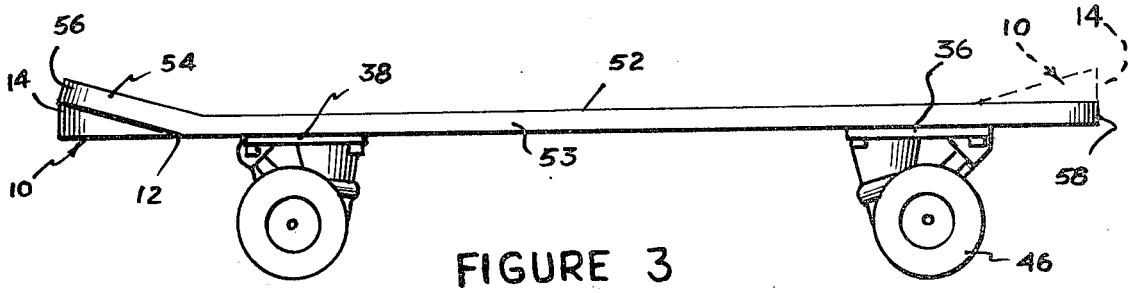
FIG. 3 illustrates a kicktail skateboard modified with the wedge accessory.

Referring now to FIG. 3, the invention is shown as employed on a skateboard 52 which has fore and aft trucks 36 and 38, respectively, which are substantially of the same construction as previously described. The skateboard platform 53, however, does not have a flat deck as the skateboard previously described. Instead, the distal portion 54 of platform 53 is inclined upwardly at an angle of about 15° in the manner characteristic of the "kicktail" skateboard platforms.

The accessory wedge 10 of the invention is employed on the aforedescribed skateboard by mounting the wedge 10 beneath the undersurface of the inclined portion 54 of the kicktail skateboard with the sharp leading edge 12 of the wedge adjacent the inflection line between the flat portion and inclined portion 54 of platform 34. In this position, the rear edge 14 of the wedge 10 will be substantially coextensive with the rear edge 56 of the skateboard. The accessory wedge 10 in this fashion serves also as a low frictional member to prevent wear on the skateboard, defacing of the pavement and also provides a bearing contact surface of low drag characteristics which will not unduly impede free movement of the board such as could cause accidental falls and the like.

The wedge 10 of the invention can also be employed at the fore end of a skateboard on the upper surface in the manner illustrated by the broken line portion of FIG. 3. In this mounting, the thick edge 14 of the accessory wedge 10 is mounted coextensively with the leading edge 58 of the platform 53. In this fashion, the wedge 10 serves to convert the single kicktail skateboard into a double kicktail skateboard.

Figure 4:
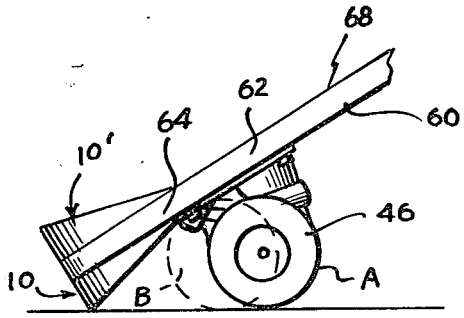
FIG. 4 illustrates a flat skateboard modified with two of the wedge accessories at its aft end.

Referring now to FIG. 4, the invention is illustrated on a skateboard 60 having a substantially flat platform 62. Two accessory wedges 10 and 10' are shown mounted on the undersurface and uppersurface, respectively, of the aft portion 64 of the skateboard. In this position, the accessory wedge 10 serves as an antifriction contact member to provide a low drag bearing contact with the pavement when the board is inclined in the illustrated manner, characteristic of a maneuvering or wheelie movement. The wedge shape of this member avoids unintended contact with the wheel 46 of the skateboard when the latter is deflected in the manner shown by arrowhead line 66 from the normal position A shown in solid lines to the maximum deflected position B shown in broken lines. This deflection occurs upon tilting of the board when the rider shifts his weight.

The second accessory wedge 10' of the invention serves in the illustrated position as a kicktail member providing an inclined raised upper surface to the deck 68 of the platform 62 whereby the skateboard is provided with improved kicktail characteristics for maneuvering movements.

The accessory wedge 10 is formed of plastics having high wear and abrasion resistance and low coefficients of friction. While various plastics can be employed for this purpose, the following are preferred materials: acetal resins such as acetal copolymer molding resins, e.g., Celcon, Delrin; fluoroplastics such as Teflon, PFA, FEP; Nylons; polycarbonates; rigid polyesters, polysulfones; and vinyl chloride-acetate molding compounds. Any of the aforementioned materials can be fiber reinforced or filled, typically with glass fibers or with fluoroplastics fibers which can constitute from 10 to about 40 weight percent of the composition. Of the aforementioned materials, the aforementioned acetal copolymer Celcon is the preferred material.

The invention has been described and illustrated with the presently preferred embodiment. It is not intended that the invention be unduly limited by this description of the ilustrated and preferred embodiment. Instead, it is intended that the invention be defined by the means, and their obvious equivalents, set forth in the following claims.

What is claimed is:

1. A combination of a skateboard and plate accessory therefor comprising:

a skateboard having an upwardly-inclined rear kicktail portion and fore and aft truck means and wheels carried thereon;

an accessory plate of low coefficient of friction plastics secured to the undersurface of the rear distal portion rearwardly of said aft truck means of said skateboard and spanning substantially the width thereof, said plate having a thin leading edge adjacent the truck means and a tapered wedge shape with a smooth planar outer face and a trailing edge of maximum thickness in edge alignment with the respective end of said skateboard and with a wedge angle from 5° to about 20°.

2. The combination of claim 1 wherein said plate if formed of acetal copolymer.

3. The combination of claim 1 wherein said plate is formed of a fluoroplastic.

4. The combination of claim 1 wherein said plate is formed of a polycarbonate.

5. The combination of claim 1 wherein said plate is formed of a rigid polyester.

6. The combination of claim 1 wherein said plate is formed of a polysulfone.

7. The combination of claim 1 wherein said plate is formed of a vinyl chloride-acetate molding compound.

8. The combination of claim 1 wherein said plate is formed of a plastic containing from 10 to 40 weight percent glass or fluoroplastic fibers.

9. A combination of a skateboard and plate accessory therefor comprising:

a skateboard substantially flat throughout its length and having fore and aft truck means and wheels carried thereon, a pair of accessory plates secured, one each, to the undersurface and to the upper surface of the rear distal portion rearwardly of said aft truck means of said skateboard and spanning substantially the width thereof said plates having thin leading edges rearward of said aft truck means and tapered wedge shapes with smooth planar outer faces, wedge angles from 5° to about 20° and trailing edges of maximum thickness, with their trailing edges in edge alignment with each other and the rear end of said skateboard.

10. The combination of claim 9 wherein another of said plates is secured to the upper surface of the forward distal portion of said skateboard.

* * * * *